US012396523B2

(12) United States Patent
Rasmussen et al.

(10) Patent No.: US 12,396,523 B2
(45) Date of Patent: Aug. 26, 2025

(54) DEFLECTABLE CLEAT SYSTEM FOR FOOTWEAR

(71) Applicant: JALMRR, LLC, Catonsville, MD (US)

(72) Inventors: Jack Stearns Rasmussen, Catonsville, MD (US); Jeffrey Mark Rasmussen, Catonsville, MD (US); Michael Steszyn, Portland, OR (US); Peter Christian Rueegger, Portland, OR (US); Joseph Fulford McMillan, III, Portland, OR (US); Peter Andrew Valois, Portland, OR (US)

(73) Assignee: Caddix, Inc., Cantonsville, MD (US)

( * ) Notice: Subject to any disclaimer, the term of this patent is extended or adjusted under 35 U.S.C. 154(b) by 0 days.

(21) Appl. No.: 18/629,829

(22) Filed: Apr. 8, 2024

(65) Prior Publication Data

US 2024/0251914 A1 Aug. 1, 2024

Related U.S. Application Data

(63) Continuation of application No. 18/281,948, filed as application No. PCT/US2023/011043 on Jan. 18, 2023, now Pat. No. 11,986,059.

(60) Provisional application No. 63/332,654, filed on Apr. 19, 2022, provisional application No. 63/300,775, filed on Jan. 19, 2022.

(51) Int. Cl.
*A43C 15/16* (2006.01)

(52) U.S. Cl.
CPC ..... *A43C 15/167* (2013.01); *A43C 15/161* (2013.01); *A43C 15/168* (2013.01)

(58) Field of Classification Search
CPC ..... A43C 15/16; A43C 15/167; A43C 15/168
See application file for complete search history.

(56) References Cited

U.S. PATENT DOCUMENTS

| | | | | |
|---|---|---|---|---|
| 2,911,738 | A | 11/1959 | Clerke | |
| 3,816,945 | A | 6/1974 | Egtvedt | |
| 4,240,215 | A | 12/1980 | Broussard | |
| 4,283,865 | A | 8/1981 | Nicholson | |
| 4,470,207 | A | 9/1984 | Bente | |
| 4,523,396 | A | 6/1985 | Dassler | |
| 5,313,718 | A * | 5/1994 | McMahon | A43B 3/0042 36/31 |
| 5,361,518 | A | 11/1994 | Sussmann | |

(Continued)

FOREIGN PATENT DOCUMENTS

| | | |
|---|---|---|
| CN | 104039191 | 9/2014 |
| EP | 0451379 | 10/1991 |

(Continued)

OTHER PUBLICATIONS

International Search Report and Written Opinion for PCT Application No. PCT/US2023/011043, mailed Jun. 7, 2023, 17 pages.

(Continued)

*Primary Examiner* — Ted Kavanaugh
(74) *Attorney, Agent, or Firm* — Ganz Law, PC

(57) ABSTRACT

A sole portion for an item of footwear having a plurality of cleat systems, cleats, or plate structures that dissipate force by deflecting, deforming, displacing or otherwise shifting under selected force, or by facilitating cleat movement around a radial line during ground engagement.

12 Claims, 15 Drawing Sheets

(56) References Cited

U.S. PATENT DOCUMENTS

| | | | | |
|---|---|---|---|---|
| 5,377,431 | A * | 1/1995 | Walker | A43C 15/168 36/134 |
| 5,682,689 | A * | 11/1997 | Walker | A43B 21/433 36/134 |
| 5,732,482 | A | 3/1998 | Remington et al. | |
| 5,743,029 | A | 4/1998 | Walker et al. | |
| 6,035,559 | A * | 3/2000 | Freed | A43B 13/141 36/134 |
| 6,442,872 | B1 | 9/2002 | Liao | |
| 7,992,324 | B2 | 8/2011 | Lacorrazza et al. | |
| 8,316,562 | B2 | 11/2012 | Locke et al. | |
| 9,700,103 | B2 | 7/2017 | Hatfield et al. | |
| 10,058,147 | B2 | 8/2018 | Wernow et al. | |
| 10,398,198 | B2 | 9/2019 | Orand et al. | |
| 11,986,059 | B2 | 5/2024 | Rasmussen et al. | |
| 2002/0088147 | A1* | 7/2002 | Joo | A43B 3/0042 36/134 |
| 2007/0251128 | A1 | 11/2007 | Yed | |
| 2010/0251578 | A1 | 10/2010 | Auger et al. | |
| 2011/0258883 | A1 | 10/2011 | Eder | |
| 2012/0066933 | A1 | 3/2012 | Meythaler | |
| 2013/0067776 | A1 | 3/2013 | Auger et al. | |
| 2014/0310995 | A1 | 10/2014 | Campari | |
| 2015/0059207 | A1 | 3/2015 | Karlsson et al. | |
| 2016/0021981 | A1 | 1/2016 | Sanchez | |
| 2019/0365036 | A1 | 12/2019 | Meeker | |
| 2020/0281323 | A1 | 9/2020 | Sanchez et al. | |

FOREIGN PATENT DOCUMENTS

| | | | | |
|---|---|---|---|---|
| EP | 3244764 | | 11/2017 | |
| FR | 2589689 | | 5/1987 | |
| FR | 2997825 | | 5/2014 | |
| GB | 2377616 | | 1/2003 | |
| WO | 0053043 | | 9/2000 | |
| WO | WO-03005845 | A1 * | 1/2003 | A43B 5/02 |
| WO | 2010133454 | | 11/2010 | |
| WO | 2014123952 | | 8/2014 | |

OTHER PUBLICATIONS

Office Action in U.S. Appl. No. 18/281,948, mailed on Jan. 22, 2024, 10 pages.

Office Action for U.S. Appl. No. 18/629,803, mailed Jun. 25, 2024, 13 pages.

International Preliminary Report on Patentability for PCT Application No. PCT/US2023/011043, mailed Aug. 2, 2024, 14 pages.

Examination Report in Australian Application No. 2023208742, mailed Aug. 20, 2024, 4 pages.

Final Office Action in U.S. Appl. No. 18/629,803, mailed Nov. 7, 2024, 13 pages.

Office Action in U.S. Appl. No. 18/629,825, mailed Feb. 3, 2025, 14 pages.

European Search Report for European Application No. 23743673.8, mailed May 13, 2025, 7 pages.

Chinese Office Action for CN Application No. 2023800180482, mailed Feb. 22, 2025, 8 pages.

Japanese Office Action in Japanese Application No. 2024-543378, mailed Feb. 25, 2025, 8 pages.

Non-Final Office Action in U.S. Appl. No. 18/629,825, mailed Feb. 3, 2025, 42 pages.

* cited by examiner

DEFLECTABLE CLEAT SYSTEM FOR FOOTWEAR

RELATED APPLICATIONS

This application claims benefit of and priority from U.S. application Ser. No. 18/781,948, filed Sep. 13, 2023, PCT Application No. PCT/US2023/011043, U.S. Provisional Patent Application No. 63/332,654, filed Apr. 19, 2022, and from U.S. Provisional Patent Application No. 63/300,775, filed Jan. 19, 2022, all of which are hereby incorporated by reference in their entireties as if fully set forth herein, for all purposes.

BACKGROUND

Many athletic and outdoor activities use cleated footwear that optimize traction for users. Conventionally, the studs or cleats improve traction for the player by partially embedding into or otherwise gripping the ground surface as the player runs, pivots and the like.

In basic terms, typical cleated or studded shoes include a sole unit with a longitudinal axis that runs from the distal (forefoot) to proximal (rearfoot) end of the shoe, generally along the midline of the shoe, separating the shoe into lateral and medial halves. A plurality of cleats are secured to the bottom of the sole so that the cleats protrude outwardly from the sole and are adapted to engage and partially embed into or firmly grip the ground support surface. (As used herein, a "cleat" means a cleat or stud that has a discrete, protruding form that projects from the bottom of a sole as either a fixed or non-removable extension of the plate or web, or one that can be removed/replaced. Cleats are typically found on athletic footwear like football (American) or soccer shoes or boots and similar footwear for use on generally soft playing surfaces like natural or artificial turf. Cleats and similar structures may also be used on other sports shoes like golf shoes or non-athletic shoes where enhanced traction might be needed.

Although the previously known cleated athletic shoes improve traction for the player while running, they also increase the risk of injury to the athlete's knee and ankle ligaments. More specifically, since cleated athletic shoes partially embed into, or firmly grip, the ground, a laterally inward force on the player's lower extremities would normally cause the player's lower extremities to deflect inwardly. However, since the cleats on these previously known athletic shoes grip the ground and resist this laterally inward movement, injuries can and do occur. Certain types of injuries, such as injuries to the ligaments, cartilage, and other soft tissue, can cause permanent damage to the player.

SUMMARY

The inventive subject matter in simplest terms is directed to a sole portion for an item of footwear having a plurality of cleat systems, cleats, or plate structures that dissipate force by deflecting, deforming, displacing or otherwise shifting under selected force, or by facilitating cleat movement around a radial line during ground engagement.

In one possible embodiment, the inventive subject matter is generally directed to a sole portion of a shoe. The sole portion includes a plurality of cleat systems disposed on a sole plate. Each cleat system has a cleat disposed on the sole unit, each cleat having a head portion for engaging a ground surface and a base portion that is disposed on the sole unit. Each cleat is associated with an elastomeric structure that under sufficient lateral load deflects or deforms and thereby allows the cleat to laterally deflect or deform.

In the foregoing or other embodiments, each cleat system may have a head portion that is disposed under a body portion, the head portion being relatively firmer than the body portion and suitable for penetration into the selected ground surfaces, and the body portion being made of an elastomeric material that is laterally deflectable or deformable under higher loads typically encountered in athletic or outdoor use, and wherein the base portion has an oblong or elongate profile that allows for anisotropic deformation under lateral loads.

In the foregoing or other embodiments, the cleat systems or cleats may be arranged in a generally radial pattern.

In the foregoing or other embodiments, the cleats may have an elongate, arcing shape.

In the foregoing or other embodiments, for each cleat in a cleat system there is an anchor disposed on the sole plate that extends downwardly into a cavity in each of the cleats, and the elastomeric structure is disposed around the anchor, or a selected side of the anchor, and between the walls of the cavity, the cleat thereby being free to move over the anchor and relative to the sole plate under sufficient lateral force, based on compression of the elastic material in response to the force.

In the foregoing or other embodiments, the sole plate may include lower and upper plates that are configured to move laterally relative to one another via the elastomeric structure and thereby cause lateral movement of the cleat systems.

In the foregoing or other embodiments, the elastomeric structure may be an elastomeric pad that is disposed between the lower and upper plates and interconnected to one or both plates, the deformation of the elastomeric pad, allowing for the relative movement of the plates.

In the foregoing or other embodiments, a plurality of elastomeric strut elements may be disposed between the lower and upper plates and are operationally interconnected to one or both plates, the deformation of the elastomeric struts allowing for the relative movement of the plates.

In the foregoing or other embodiments, the sole unit may be configured with a pivot point around which the sole unit or a plate therein can move in a radial path.

In the foregoing or other embodiments, the pivoting may be attained by providing a pin element that spans the plates and an intermediate elastomer pad, allowing the lower plate to pivot relative to the upper plate.

In the foregoing or other embodiments, the lower and upper plates may have differential firmness so that one plate elastically deforms relative to another under compressive loads, opposing surfaces of the plates being separated by one or more spacers that engage an elastically deformable surface to deform that surface under load.

In another possible general embodiment, the inventive subject matter is directed to a sole portion of a shoe that includes a plurality of cleat systems disposed on a sole plate. Each cleat system or cleat has or is associated with an elastomeric structure that under sufficient lateral load allows for the cleat to laterally and/or vertically shift. The sole plate includes lower and upper plates that are configured to move relative to one another thereby providing the lateral and/or vertical shifting. And the lower and upper plates have differential firmness so that one plate elastically deforms relative to another under compressive loads, opposing surfaces of the plates being separated by one or more spacers that engage an elastically deformable surface of a plate to deform that surface under load.

In the foregoing or other embodiments, each cleat system may have a top portion and base portion, the base portion being fixed to the sole plate, and the top portion being segmented along lines generally orthogonal to the surface of the sole plate, each segment being elastically laterally displaceable under sufficient force.

In the foregoing or other embodiments, to control the direction of displacement of the segments, they may be disposed in a groove or slot that is configured with side walls that anisotropically control the direction and/or range of displacement of the segments.

In the foregoing or other embodiments, the cleat systems may be arranged in a radial pattern and the cleats may be configured to deflect along the radial line of the pattern.

In the foregoing or other embodiments, there may be a first plurality of cleat systems disposed on a sole plate, and a second plurality of cleat systems disposed on the sole plate, the first plurality of cleat systems being configured to provide for pivoting around a point defined by the arrangement of cleat systems, and the second plurality of cleat systems being configured to avoid impeding the pivoting action of the first plurality.

In the foregoing or other embodiments, the cleats in the first plurality of cleats may be taller than the cleats in the second plurality of cleats, the first plurality of cleats being arranged around a selected point for pivoting.

In the foregoing or other embodiments, the selected point of pivoting may be at a position on the sole plate that corresponds to user's first metatarsal head or thereabout.

In the foregoing or other embodiments, the sole portion may be a forefoot portion.

In the foregoing or other embodiments, the sole portion may be configured with a pivot point at or about a position corresponding to the first metatarsal head.

In another possible general embodiment, the inventive subject matter is directed to sole portion of a shoe, having a plurality of cleat systems. Each cleat system has a cleat having a head portion for engaging a ground surface and extending therefrom a post portion that has an end that engages a sole plate in the sole portion. The sole portion includes a concave or convex receptacle portion in the sole plate portion. The cleat post portion includes a section having a complementary convex or concave shape that pivotably engages with the concave or convex receptacle portion in response to the shear force. And, one or more elastomeric elements are included in the cleat system that engage with the cleat head portion and/or the post to control the degree of deformation or deflection in response to a lateral shear force and to restore the cleat to its neutral position once the force is removed.

In the foregoing or other embodiments, the elastomeric elements may be configured and/or disposed to directionally control the deformation or deflection of the cleat.

In the foregoing or other embodiments, the cleat system may be configured to anisotropically allow for deformation or deflection primarily toward one of the lateral or medial sides of the shoe in response to a predetermined magnitude of shear force imposed upon the cleat.

In the foregoing or other embodiments, the sole portion may include a convexity in the sole plate and a concavity in the cleat head portion, the convexity and concavity being pivotably engageable under the shear force.

In the foregoing or other embodiments, the convexity includes a channel through which the cleat portion passes, and which defines a predetermined amount of travel for the cleat post portion.

In the foregoing or other embodiments, at least one elastomeric element may be disposed in the channel, the elastomeric element being in operative engagement with the post and convexity to control the degree of deflection of deformation.

In the foregoing or other embodiments, the cleat post may be disposed in a channel of the sole plate and the elastomeric element is disposed adjacent the cleat post within the channel so that it operatively engages the cleat post and the sole plate.

In the foregoing or other embodiments, the elastomeric element may be a ring disposed around the cleat post.

In the foregoing or other embodiments, the receptacle may be at least partially disposed in a channel of the sole and the elastomeric element is disposed adjacent the portion of the receptacle that is within the channel so that it operatively engages the receptacle and the sole plate.

In the foregoing or other embodiments, the cleat post may be disposed in a channel of the sole plate and the elastomeric element is disposed adjacent the cleat post within the channel so that it operatively engages the cleat post and the sole plate.

In the foregoing or other embodiments, an operative interface between the cleat head and the sole plate one or both of the cleat head and sole portion at the interface area may be an elastomeric portion. In the foregoing or other embodiments, the elastomeric element at the interface may be an elastomeric base portion of the cleat head. In the foregoing or other embodiments, the elastomeric element at the interface may be an elastomeric base portion of the sole plate.

In another possible general embodiment, the inventive subject matter is directed to an item of footwear, having a cleat system. The footwear includes an upper configured to receive a wearer's foot and a sole unit coupled to the upper for engaging the ground. The sole unit has a plurality of cleats protruding from the ground-facing surface of the sole unit. Each cleat being in a cleat system that includes a cleat. The cleat has a head portion and base portion. The cleat is coupled to a post having a first end fixedly or removably anchored to the cleat and a second end fixedly or removably anchored to a plate portion in the sole unit. The cleat is laterally deflectable by (i) pivoting of the second end of the post relative to the plate portion and (ii) by pivoting and/or deformation action by an engagement of the base of the cleat with the ground-facing surface of the sole unit.

In the foregoing or other embodiments, the deflectability may be facilitated by pivoting of complementary convex and concave surfaces associated with the second end of the post and the plate.

In the foregoing or other embodiments, the concave/convex surfaces may be associated with the post and a receptacle included in the plate portion.

In the foregoing or other embodiments, the concave/convex surfaces may be associated with a receptacle included in the plate portion and a sidewall of the plate portion.

In the foregoing or other embodiments, the deflectability may be facilitated by pivoting of complementary convex and concave surfaces associated with the base of the cleat and the ground-facing surface of the sole unit.

In the foregoing or other embodiments, the deflectability may be facilitated by deformation of the base portion of the cleat and/or a mounting portion of the sole unit adjacent the base portion.

In other possible general embodiments, the inventive subject matter is directed to methods of manufacturing any of the foregoing embodiments. For example, in one possible method, the inventive subject matter is directed to a method of making a sole plate that includes the following steps: providing a cleat having a head portion for engaging a ground surface and extending therefrom a base or post portion that has an end that engages a sole plate for a sole portion of a shoe, a concave or convex receptacle portion is included in the sole plate portion, the cleat post or base portion including a section having a complementary convex or concave shape that pivotably engages with the concave or convex receptacle portion in response to the shear force; and providing one or more elastomeric elements in the cleat system that engage with the cleat head portion and/or the post to control the degree of deformation or deflection in response to a lateral shear force and to restore the cleat to its neutral position once the force is removed.

In another possible general embodiment, the inventive subject matter is directed to a sole portion of a shoe that includes a plurality of cleat systems disposed on a sole plate, each cleat system having a cleat body with one or more buttresses disposed on sides of the cleat body, at least one buttress restricting the deflectability or deformability of the cleat body. The buttress is configured for selected modification that unrestricts the deflectability or deformability of the cleat body in a selected lateral or vertical direction and/or with selective removal and replacement with a different cleat that has different deflectability or deformability properties.

In the foregoing or other embodiments, the buttress may be configured for a selected modification that provides for directional control of the deflection or deformation of the cleat.

In the foregoing or other embodiments, the cleat systems may be configured for anisotropic deflection or deformation primarily toward one of the lateral or medial sides of the sole portion in response to a predetermined magnitude of shear force imposed upon the cleat.

In the foregoing or other embodiments, each modifiable buttress includes a scoring line indicating to a user how to sever the cleat for the selected modification.

Various embodiments according to the inventive subject matter are described in more detail in the following detailed descriptions and the figures. The appended claims, as originally filed in this document, or as subsequently amended, are hereby incorporated into this Summary section as if written directly in. The foregoing is not intended to be an exhaustive list of embodiments and features of the inventive subject matter. Persons skilled in the art are capable of appreciating other embodiments and features from the following detailed description in conjunction with the drawings.

BRIEF DESCRIPTION OF THE DRAWINGS

The appended figures show embodiments according to the inventive subject matter, unless noted as showing prior art.

FIG. 10 shows a bottom view of a sole unit embodying a set of deflectable or deformable cleat systems.

FIG. 11 shows a bottom view of another embodiment of a sole unit embodying a set of deflectable or deformable cleat systems.

FIG. 12 shows a bottom view of another embodiment of a sole unit embodying a set of deflectable or deformable cleat systems.

FIG. 13 shows a bottom view of another embodiment of a sole unit embodying a set of deflectable or deformable cleat systems.

FIG. 14 shows a side view of another embodiment of a shoe with a sole unit embodying a set of deflectable or deformable cleat systems.

FIG. 15 shows a side view of another embodiment of a shoe with a sole unit embodying a set of deflectable or deformable cleat systems.

FIG. 16 shows a bottom view of another embodiment of a sole unit embodying a set of deflectable or deformable cleat systems.

FIG. 17 shows a bottom view of another embodiment of a sole unit embodying a set of deflectable or deformable cleat systems.

FIG. 18 shows a side view of another embodiment of a shoe with a sole unit embodying a set of deflectable or deformable cleat systems.

FIG. 19 shows a bottom view of another embodiment of a sole unit embodying a set of deflectable or deformable cleat systems.

DETAILED DESCRIPTION

Figure 1:
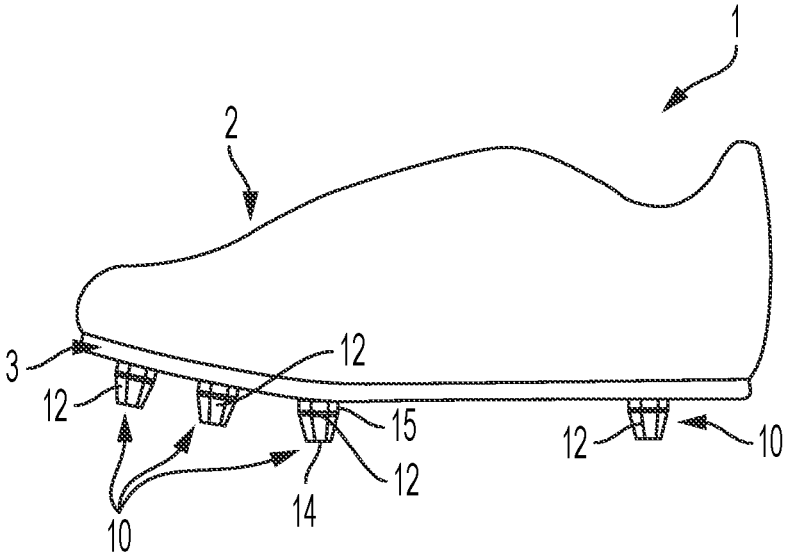
FIG. 1 shows a side view of a representative cleated athletic shoe (with a right shoe being shown and the left shoe being a mirror image.)

Representative embodiments according to the inventive subject matter, and features thereof, are shown in FIGS. 1-19, wherein the same or generally similar features may share common reference numerals. Figures are for illustrative purposes and are not necessarily to scale.

The inventive subject matter is generally directed to a cleat system that allows for lateral deformation or deflection of the cleat in response to a predetermined magnitude of shear force imposed upon the cleat. In certain embodiments, the cleat system includes a concave or convex receptacle portion in sole plate portion of the shoe's sole assembly, the cleat includes a post portion that has a complementary convex or concave shape that pivotably engages with the concave receptacle portion in response to the shear force. Elastomeric elements are included in the system that engage with the cleat head and/or the post to control the degree of deformation or deflection and to restore the cleat to its neutral position once the force is removed. In some embodiments, the elastomeric elements are configured and/or disposed to directionally control the deformation or deflection of the cleat. For example, the cleat system can be configured to anisotropically allow for deflection primarily toward one of the lateral or medial sides of the shoe.

FIG. 1 shows an athletic shoe 1 having an upper 2 and a sole unit 3 associated below the upper. The sole unit has a longitudinal axis that runs from the distal (forefoot) end of the shoe to the proximal (rearfoot) end of the shoe. (Reference numbers used herein may be general indicators of common structures, although as will be apparent from the figures and text, details may vary from figure to figure.) The sole unit may have multiple components, including any one or more of an insole, Strobel or other lasting board, midsole or other cushioning element, rigid or semi-rigid plate (for example polymers like plastic, firm elastomers; semi-rigid board; composite like carbon fiber or fiberglass; thermosettable materials; metal; leather; etc.), and/or outsole. Any such materials can correspond to the full length and width of a foot or to portions thereof. Such components are well known to persons skilled in the art. Suitable plastics and elastomers include thermoplastic and thermoelastic polymers.

The shoe includes a cleat system 10 with a plurality of spaced cleats or studs 12 provided on the sole unit 3 so that the cleats protrude outwardly from the bottom of the sole unit. The cleats are adapted to embed or grip into a yieldable ground support surface in order to improve traction for an athlete or other user. Some of the plurality cleats are disposed in the forefoot section of the sole unit and some are disposed in the rearfoot section of the sole unit. The cleats may be removably attached to mounting areas 20 in the sole unit 3 using threaded posts. The number of cleats on the shoe, their size and shape, and their spacing and arrangement may vary considerably, as is well known in the art. One or more of the cleats may be deflectable. Not all the cleats need to deflectable. For example, the deflectable cleats could be included just in the forefoot region of the shoe and not included in the rearfoot region. Further, of the deflectable cleats, some may deflect differently than others in terms of direction and/or angle of deflection. More details on the cleats and their mounting on the sole unit are provided below.

Figure 2A:
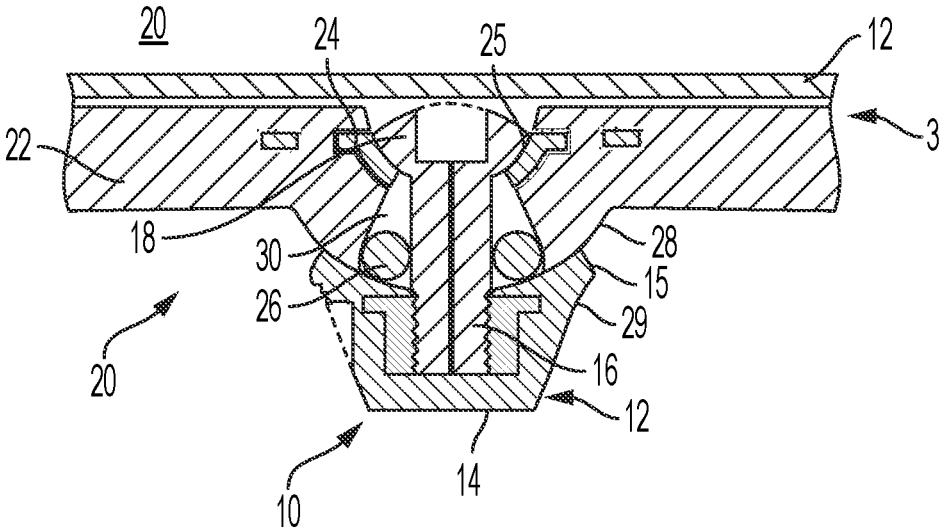
FIG. 2A schematically shows an elevational cross section of a cleat system that may be used in the athletic shoe of FIG. 1, with the cleat in a neutral, unloaded condition.
Figure 2B:
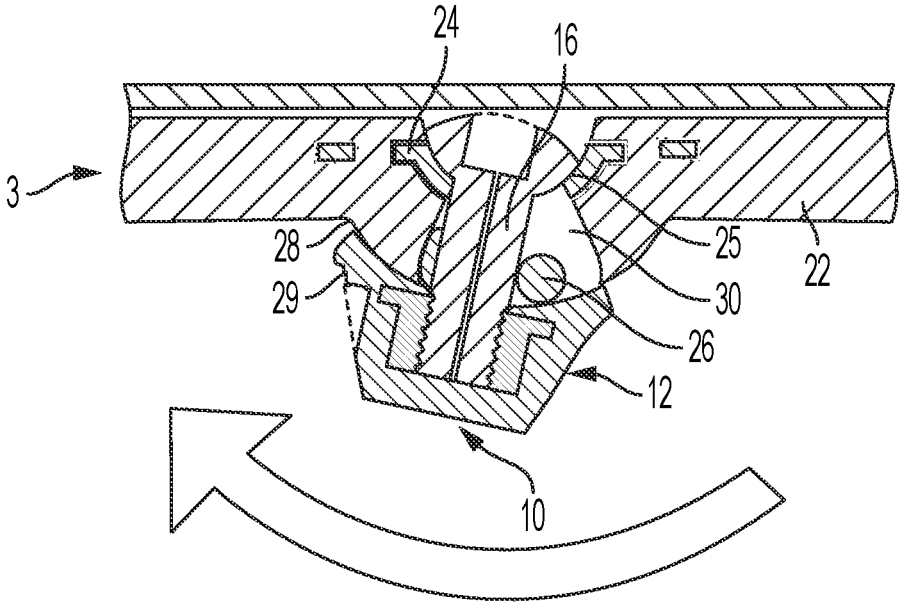
FIG. 2B shows the cleat of FIG. 2A with the cleat deflected in a predetermined direction, and at a predetermined angle relative to the bottom of the shoe, under a predetermined lateral, directional load.

FIGS. 2A-2B show one possible example of a cleat system 10 having plurality of deflectable cleats 12. The system includes cleats 12 each in the mounting area 20 of the sole unit 3.

Cleat 12 includes a head portion 14 for engaging a ground surface and a base portion 15 that is situated adjacent the sole unit. Extending from the head portion is a post 16 that has an end portion 18 that engages a receptacle in the mounting area. Typically, the post is made of metal or other structurally sound material that will not yield under the compressive forces normally encountered during conditions of intended use. (The post portion may be simply referred to as the "post".) In the example of FIGS. 2A-2B, the post may be a threaded member that engages with female threads in the head portion. The post can be prefixed to the head or to the sole unit. The post may be a rigid structure or one that is substantially rigid, but which may elastically deform to a desired degree under compressive, tension, or bending forces.

The mounting area 20 of the sole unit may be a firm material, e.g., a rigid or firm plate structure 22 for fixing the cleats to the sole unit. In the example shown, the sole unit includes a relatively rigid sole plate 22 at least in the areas where cleats are to be mounted. The sole plate shown includes a fixed concave receptacle portion 24. (In other embodiments, the receptacle portion may be convex.) The open side of the receptacle faces away from the bottom of the shoe. The end portion 18 of the cleat post includes a section 25 having complementary convex shape to the receptacle's concave surface. The convex structure thereby can pivotably engage the concave receptacle portion 24 in response to a lateral force, allowing cleat 12 to deflect in any desired direction. Various materials may be used to manufacture the sole plates discussed herein. For example, a thermoplastic elastomer, such as thermoplastic polyurethane (TPU), a glass composite, a nylon including glass-filled nylons, a spring steel, carbon fiber, ceramic or a foam or rubber material (such as but not limited to a foam or rubber with a Shore A Durometer hardness of about 50-70 (using ASTM D2240-05 (2010) standard test method) or an Asker C hardness of 65-85 (using hardness test JIS K6767 (1976) may be used for the sole plate. Other natural and synthetic materials, as discussed above for the sole unit, may also be suitable.

Suitable mounting area or other sole plate portions include, TPU, nylon, Pebax, and composites. Similarly, cleats may be made in whole or part from such materials, as well as many others known to persons skilled in the art.

To control the degree or angle of deflection, one or more resilient, elastomeric elements 26 are included in the cleat system that engage with the cleat head portion and/or the post 16 to control the degree of deformation or deflection in response to a lateral force and to restore the cleat to its neutral position once the force is removed. The elastomeric elements serve as resilient bumpers that control the range of deflection or deformation of the cleat. Typically, the elastomeric elements are moldable polymer materials, e.g., natural or synthetic rubbers or rubberlike materials. However, they could also be mechanical springs, e.g., a compression spring. The elastomeric elements may be discrete structures directly or indirectly operatively coupled to other components of the cleat system. They can also be integrated with other components into a unitary structure, e.g., by co-molding of materials having different material properties.

In the embodiment of FIGS. 2A-2B, deflectability is facilitated by annular elastomeric element 26. The elastomeric element is interposed between the post end portion 18 and the sole plate 22 and is operatively coupled to those components. As seen in the Figures, the sole plate includes a channel or other cavity 30 that is wider than the post and defines a degree of travel or free play for the post and associated cleat on compression of the elastomeric element. In this embodiment, the elastomeric element fills in the gap between the walls of the cavity.

As seen in FIG. 2B, under force, the elastomeric element deforms under lateral load to facilitate deflection of the post and cleat. In this example, because the elastomeric element is annular and fits into a complementary round channel in the sole plate, the cleat can directionally deflect 360 degrees and to a predetermined angle, in this exemplary case about 12 degrees (angle of post relative to sole plate).

In other cases, the cavity can be a directional channel that restricts the direction and degree of deflection. For example, the channel could be an oval with a longitudinal axis oriented between the lateral and medial sides of the shoe, i.e., the shoe's latitudinal axis. The channel could be sized and shaped to allow a predetermined amount of free-play along the longitudinal axis and a different amount of free-play along the shoe's latitudinal axis. For example, there might be little or no free play along the shoe's longitudinal axis and significant free play along the shoe's latitudinal axis.

In the embodiment of FIGS. 2A-2B, the sole plate 22 has a protruding or convex region 28 over the mounting area on the outward facing side of the sole. The surface of the convexity is configured to pivotably engage with a complementary concave surface 30 on the bottom of cleat.

Figure 3:
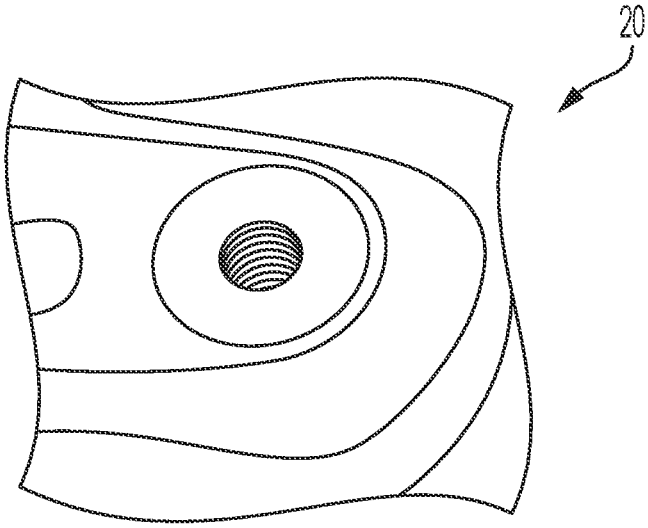
FIG. 3 shows an isolated plan perspective view of a cleat mounting area that may be included on sole unit for a cleated shoe.

FIG. 3 shows an isolated plan perspective view of a cleat mounting area that may be included on sole unit for a cleated shoe.

Figure 4:
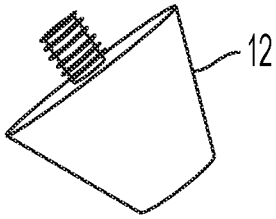
FIG. 4 shows an elevational side perspective view of a removable cleat that may be mounted to the mounting area of FIG. 3.

FIG. 4 shows an elevational side perspective view of a removable cleat that may be mounted to the mounting area of FIG. 3.

Figure 5:
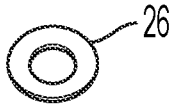
FIG. 5 shows a plan perspective view of an elastic element that limits cleat deflectability in a cleat system and promotes the cleat's return to center while also sealing the shoe against the introduction of debris into the cleat housing.

FIG. 5 show a plan perspective view of an elastic element that limits cleat deflectability and promotes return to center in a cleat system, while also sealing the shoe against the introduction of foreign, unwanted debris into the cleat housing.

FIGS. 6-9 show variations of the inventive subject matter. In these alternative embodiments, the cleat systems use female threaded receptacle like seen in FIG. 3 and a cleat with a fixed, threaded post element like seen in FIG. 4.

Figure 6:
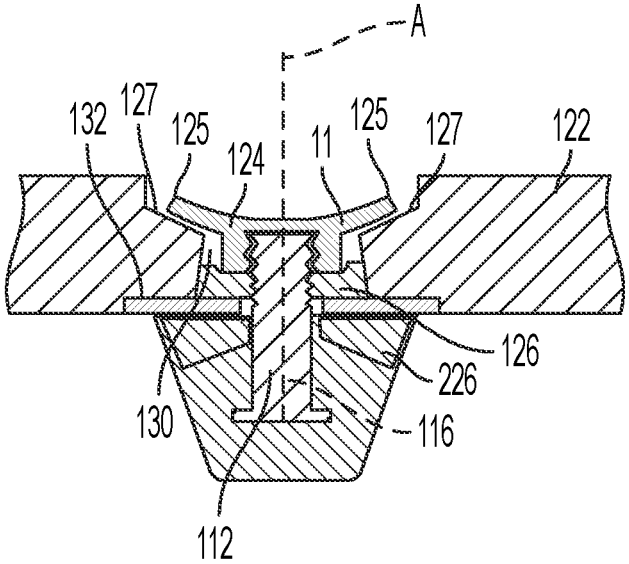
FIG. 6 schematically shows an elevational cross section of an alternative cleat system that may be used in the athletic shoe of FIG. 1, with the cleat in a neutral, unloaded condition.

In the embodiment of FIG. 6, post 116 has a portion anchored into the cleat 112 and a threaded portion that extends from the cleat into a complementary threaded region of receptacle 124. The receptacle has a flange portion 125 that is convex on a side that engages a concave portion 127 of the sole plate 122. The sole plate includes a cavity or channel 130 that defines a range of free play for the post and associated cleat. A resilient, elastomeric element 126 is interposed between the post and sidewalls of the cavity to control the range of deflection of the post and cleat. The bottom of the cleat also includes an annular elastomeric element 226 in the nature of a resilient, elastically deformable material to facilitate deflection in response to lateral forces.

The sole plate could be reinforced with a rigid washer or metal plate 132 where it abuts the bottom of the cleat. The rigid and elastically deformable portions of the cleat could be a unitary structure that is formed of different co-molded polymer materials. Or they could be discrete structures that are bonded or otherwise affixed together. The portion of the post that inserts into the cleat could be fixedly or removably anchored to the cleat by, for example, insert molding, thread fastening, chemical or thermal bonding, etc. Based on the arrangement of elastomeric elements 126 and 226 on the inner and outer sides of sole plate 122, the cleat can rock in different directions. When elastomeric element 226 is compressively deformed to one side, the axis of the cleat's post and the cleat angles to that side. On the opposite side of the post, receptacle flange 125 moves downward onto elastomeric element 126, which compressively deforms to that opposite side. Notably, the embodiment's arrangement of elastomeric elements also allows for cushioning of longitudinal or vertical compressive forces on the cleat.

Figure 7:
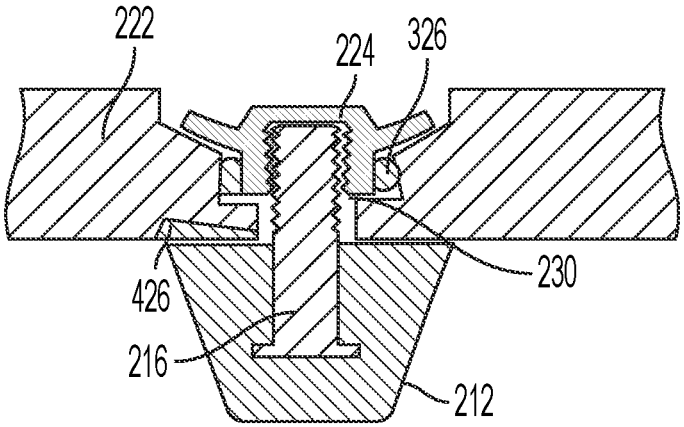
FIG. 7 schematically shows an elevational cross section of another alternative cleat system that may be used in the athletic shoe of FIG. 1, with the cleat in a neutral, unloaded condition.

The embodiment of FIG. 7 is similar to the embodiment of FIG. 6. One difference is that instead of interposing an elastomeric element 126 between the cleat's post 216 and the walls of cavity 230 in the sole plate 222, the elastomeric element 326 is disposed between the outer wall of receptacle 224 and the cavity walls. There is no significant functional difference because the receptacle and post are physically coupled together in a unitary structure. Another difference is that instead of the bottom portion of the cleat being deformable, the sole plate includes a resiliently deformable elastomeric element 426 where it is adjacent to and abuts the bottom of the cleat 212. In this case, the element is not circumferential but is on a selected side of the sole plate 422. This provides anisotropic deflection of the cleat and post to that side under a lateral force from the opposite side.

Figure 8:
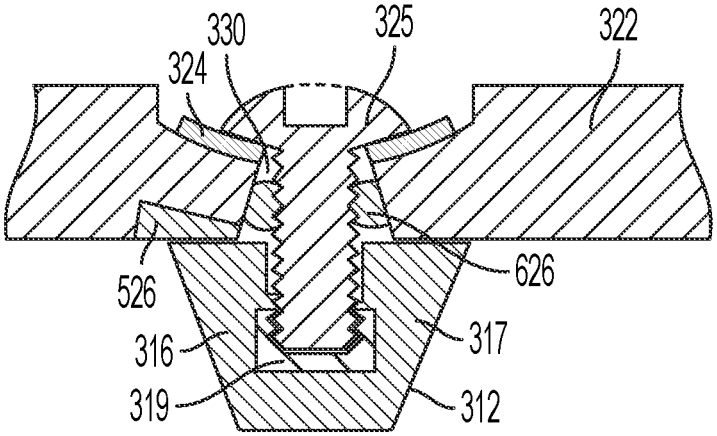
FIG. 8 schematically shows an elevational cross section of another alternative cleat system that may be used in the athletic shoe of FIG. 1, with the cleat in a neutral, unloaded condition.

FIG. 8 shows another alternative embodiment similar to the embodiments of FIGS. 6-7. One difference is that post 316 is removably anchored to the cleat 312 via threaded elements. The post includes a cleat engaging portion 317 with male threads that screw into a receptacle 319 with complementary female threads. The receptacle may be insert-molded into the cleat. Another difference is the opposing end portion 325 of the post 316 that anchors into the sole plate has a rounded bolt head with a recess for engaging a tool, e.g., a screw driver, hex wrench, star driver, etc. (The embodiment of FIG. 2A is shown with a post 16 that has a similarly configured end portion.) The outward facing side of the sole plate 322 includes an integrated elastomeric element 526 that deformably engages with the base of the cleat head, like the embodiment of FIG. 7. In the embodiment of FIG. 8, the elastomeric element 626 is not directly coupled to the post 316. The post pivotably anchors into the sole plate via a receptacle 324 in the sole plate. Elastomeric element 626 is interposed between the receptacle and surrounding walls in the sole plate. Therefore, the receptacle and post and cleat are coupled together and deflect as a unit under lateral forces.

Figure 9:
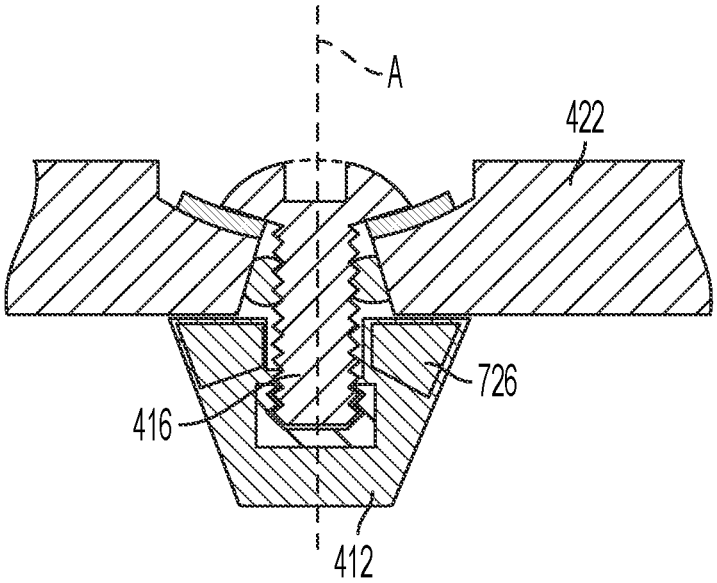
FIG. 9 schematically shows an elevational cross section of another alternative cleat system that may be used in the athletic shoe of FIG. 1, with the cleat in a neutral, unloaded condition.

The embodiment of FIG. 9 is the same except instead of having an elastomeric element 526 integrated into the sole plate 422, an elastomeric element 726 is integrated into the base of the cleat like in the embodiment of FIG. 6.

Accordingly from the foregoing disclosure, it can be appreciated that different arrangements of elastomeric elements may be directly or indirectly coupled to the cleat system components to allow for deflection under transverse forces.

During athletic play, the imposition of shear (lateral forces), may cause injury to an athlete and particularly injury to the athlete's joints, cartilage, tendons, and ligaments in the knee and ankle. Or such forces may result in stress to joints, cartilage, tendons or ligaments, which could be mitigated by dampening systems in a shoe.

As shown in FIG. 2B, in response to a predetermined laterally inward force, a cleat 12 yields by pivoting in any of a 360-degree range or selected portions of a 360-degree range, e.g., just to the lateral and/or medial side of the show.

Looking at the shoe of FIG. 1, which is a right shoe (a left shoe, not shown, being a mirror image) The distal or forefoot side of the cleat may be considered 0 or 360 degrees and the proximal or rearfoot side of the cleat may be considered the 180 degrees. The lateral or left side of the shoe would be at 90 degrees and the medial or left side would be at 270 degrees.

In some embodiments, using a right shoe as a reference point, a cleat may deflect in a direction that is toward the lateral side of the shoe and/or the medial side of the shoe, i.e., in a direction between 0-180 degrees (lateral side) and/or in a direction of from 180 degrees to 360 degrees (medial side). In some embodiments, there may be little or no deflection along the longitudinal line of the shoe. For example, the deflectability could be limited to a range of 90 degrees plus or minus 45 degrees and/or 270 degrees plus or minus 45 degrees.

So far we have been discussing directions of deflection. The cleats have a vertical axis (e.g., the axis A in FIG. 9) that makes an angle relative to the bottom of the sole unit. In general, the vertical axis will be perpendicular to the plane of the bottom's surface. When the cleats deflect in a particular direction, the cleat's vertical axis with the sole unit will change. Depending on the force, and the predetermined force for deflection built into the cleat assembly, a cleat may be designed to displace from 0 degrees to 45 degrees, in response to forces normally encountered by humans during athletic use of the shoe. In some embodiments that cleats can deflect from 2-20 degrees, in some embodiments, the cleats can deflect from 5-20 degrees, in some embodiments the cleats can deflect 12 degrees plus or minus 3 degrees.

From the foregoing disclosure, it can be appreciated that all variations in FIGS. 1-9 are based on a stud or cleat that is attached to a post that connects to a sole unit. On the side of the sole plate that is opposite the ground-facing side, or within the sole plate, the cleat and/or its receptacle; has one end that pivots (which is broadly used to mean pivot, swivel, or otherwise allow relative rotation between items) so that there is deflection or deformation of a cleat relative to the sole's ground-facing surface using complementary, curved, and preferably low-friction, bearing surfaces. On the ground-facing side of the sole, the base of the cleat also is pivotable or deformable using similar complementary curved bearing surface or via deformable elements integrated into the base of the cleat and/or the abutting area of the sole plate (or another sole surface). In other embodiments, the base of a cleat is not centered on fixed point but can shift, e.g., the entire cleat remains perpendicular to the sole but moves in a lateral direction off a center point under lateral force.

Figure 10:
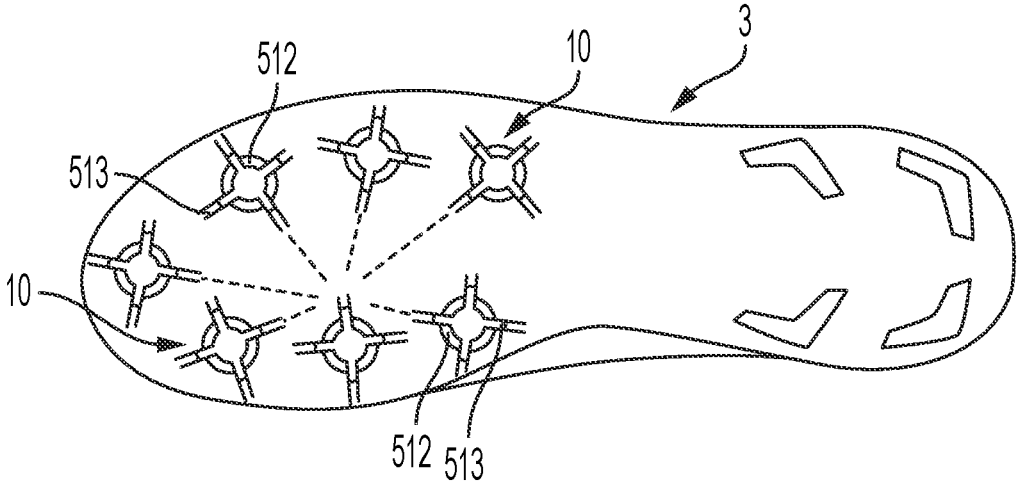
FIGS. 10-19 show various other possible embodiments of the inventive subject matter. (A main view of an embodiment is labeled with a figure number and additional views of the embodiment, or portion thereof, include an alphabetical label, e.g., FIG. 10A, 10B, . . . )

FIGS. 10-19 show additional embodiments of deflectable or deformable cleats according to the inventive subject matter. FIG. 10 shows a tunable cleat or stud system 10 on a sole unit 3. Each system includes a cleat body 512 and one or more associated buttress portions 513 disposed on a vertical side portion of the cleat body 12 that span to the bottom of the sole unit. One or more buttresses on a cleat body are modifiable so that there is less support and thereby the associated cleat body is more deflectable or deformable.

As in various other embodiments, the cleat body may have a tapered shape, which in this example is a truncated conical shape. The base portion 515 of the buttress may or may not be connected to the sole unit, but in either case, at least before modification, it would be firmly pressed against the sole unit to provide support.

In the illustrated embodiment, the cleat systems are disposed in a forefoot-midfoot portion of the footwear, but in other embodiments, they may be arranged in any one or more of the forefoot, midfoot, and/or rearfoot portions of the sole unit (as is generally true for any other embodiment disclosed herein.) In general, the cleats have tuned deflectability by reducing the support of one or more buttress. The directionality of deflection is tunable by selecting which buttresses are modified by a user.

In one possible embodiment, a cleat body 512 is made of less rigid material than traditional hard plastic cleats so that without a buttress it would have some deflectability. For instance, the body could be a plastic or elastomer having a durometer of Asker 40A to Asker 90A (soft rubber to very firm plastic) or thereabout either range point. The buttresses are a relatively more rigid material, for example a thermoplastic having durometer of Asker 40A to Asker 55D. Thereby, the relatively higher rigidity of the buttress restricts the deflectability of the body portion. In other embodiments the cleat body and/or the buttresses need not be made of a thermoplastic. For example either the cleat body could be a metal or other rigid structure that is deflectable by an elastomeric system, as described above for the embodiments of FIGS. 1-9.

In the illustrated embodiment, the buttresses are fin-like elements that physically span between the cleat body and the sole plate to brace the cleat body. The fins may be disposed along the entire length of the cleat body or partially along the length. The cleat bodies may have a length of from 4 mm to 10 mm (or thereabout either range point) and the fins may have a web thickness of 1 to 3 mm (or thereabout either range point). As seen the fins have a triangular shape that tapers downwardly going from the base of the sole unit towards the head of the cleat body. Other geometries are possible, e.g., rectilinear or curving. The buttresses may provide not only for tunable deflection or deformation of the cleat body, but they may also be ground penetrating or otherwise ground-engaging features for traction.

In addition to unitary cleat/buttress structures, the buttresses could be removable from the cleat body. For example the body could have a slot for engaging with a side of a fin-like buttress. In other embodiments, the connection could be with screws or other known fastening systems. By making buttresses removable, they may be replaced to give the user more tuning options, as needed to adjust to varying conditions or circumstances. Similar advantages are achieved by making the entire cleat system 10 removable and replaceable.

A cleat system can be a unitary structure with the sole unit, e.g., co-molded but with varying durometers to provide functions indicated. Or the cleat system could be a discrete item that integrates with the sole unit, e.g., using a threaded post system, as are generally known.

Any given buttress can have one or more scoring lines 517 where the buttress can be separated into portions so that one portion is free to move relative to another portion.

The buttress may be placed anywhere around the cleat body so that the body is restricted from deflecting in a direction toward the buttress. In the embodiment shown, there are four buttresses each at 90 degrees from the next. Therefore, the cleat body is restricted from deflecting in 360 degrees. In general, looking at any of the cleat systems 10, there are a pair of opposing distal-proximal buttresses, restricting fore-aft deflection along roughly a longitudinal line of the sole unit) and a second pair of opposing lateral-medial buttresses, restricting longitudinal movement of the cleat body. However, as can be seen opposing pairs of buttresses for a given cleat system may have an alignment that is transverse to the to the longitudinal and latitudinal axes of the sole unit. Although the illustrated embodiment shows four evenly spaced buttresses around a cleat body, more or fewer buttresses may be used. For instance, to tune for lateral deflection, only a single buttress need be placed on a lateral or medial side of a cleat body.

Figure 10A:
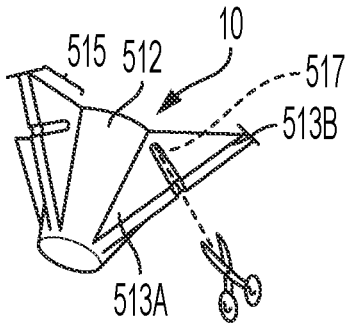
FIG. 10A is an isolated view of a cleat system from FIG. 10.

Tunability of a cleat system may be achieved by modifying one or more scoring lines on one or more buttresses to create a severed area that weakens or eliminates the buttress's bracing. The scoring line may be a physical feature, e.g., a notch, groove, or a set of depressions or perforations in the surface of a buttress that creates a weakness that facilitates cutting or otherwise separation of the buttress into one or more portions. The line of separation may be linear, curved, or another non-linear path. For example, FIG. 10A, which is an isolated view of a cleat system 10, the scoring line 517, may be cut (as indicated by scissors icon) or otherwise severed by a user to separate buttress 513 into an upper portion 513A and a lower portion 513B. One advantage of providing scoring lines on a buttress's side is that the cleat body's head portion is structural intact for engagement with the ground. Furthermore, by providing scoring lines that are contained in buttresses, and which do not extend into the body of the cleat, the main body of the cleat remains intact and not overly weakened. (However, this is not to say that scoring lines cannot or should not be used in a cleat body.)

In addition to physical scoring into the surface of a buttress, the scoring could be visual markings such as printing of lines on the surface of buttress that indicate where a user can create a severing.

Multiple scoring lines may be provided on a given buttress to allow for different user choices and effects. For example an upper or shallow scoring line may be provided to allow for limited deflection, or a lower or deeper line one may be provided to allow for more or fully unrestricted deflection. The user can tune the footwear by not only choosing which cleat systems to modify but also which of one or more scoring lines on a given cleat system to sever or the depth of severing.

In some embodiments, the cleat system is rotatable so that buttresses can be oriented in any direction. One advantage of this is it may eliminate the need for multiple buttresses with scoring lines on a given cleat body. For example, a cleat body could have four spaced apart buttresses and only one or two would need to each have a scoring line to provide lateral or lateral-medial deflection.

Not only can lateral deflection be adjusted, but vertical (longitudinal) deflection can be provided by cutting away or otherwise removing buttressing from around the head or tip area of the cleat body to expose it. The degree of vertical deflection can be controlled by varying how much of the head portion of the cleat body is free of buttressing, thereby unrestricting the deflectability of the cleat body vertically. Cleat positions may also be varied to create custom profiles.

Certain orientations of deflectable or deformable cleats may result in either better or more appropriate traction for a specific given activity or movement. In baseball or golf, for example, it may be desirable for cleats to deform in a side-to-side (medial/lateral) or rotational manner to aid in the twisting motion of the foot during hitting/batting/swinging. During football, certain skill positions may require delayed traction for side-to-side motions (cutting) and more direct power transfer for longitudinal movements.

Figure 11:
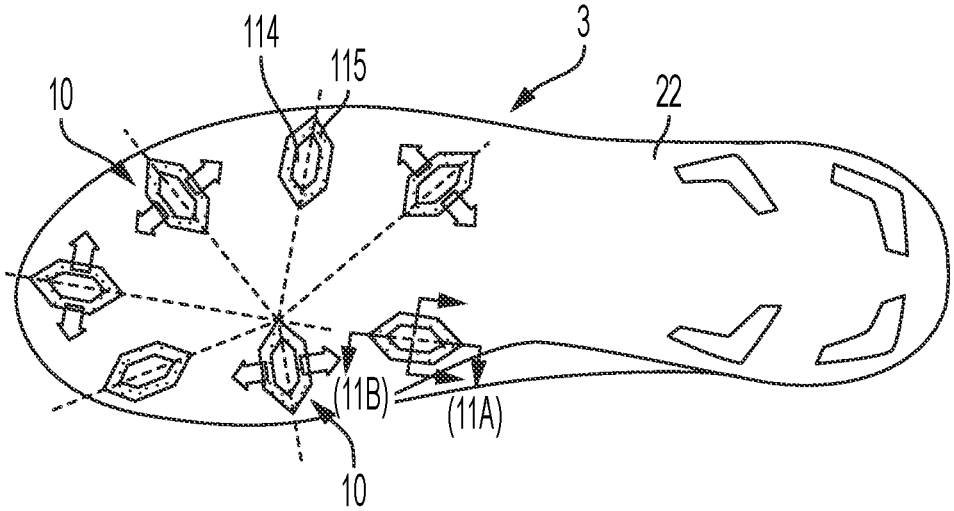

FIG. 11 shows another embodiment of a deflectable or deformable cleat system having a plurality of cleat systems 10 disposed on a sole plate 22 of sole unit 3. In this embodiment the cleat systems consist of a cleat 12 having a head portion 114 and base portion 115. The base portion connects the cleat to the sole plate or other sole unit structure. The head portion 114 is usually a rigid material suitable for engaging the ground to provide traction and some penetration into firm ground surfaces, as do traditional cleats and studs. For example, it can be a thermoplastic or firm elastomermaterial. The base portion is an elastomeric material that is capable of laterally deflecting under higher loads typically encountered in athletic or outdoor use.

At least the base portions 115 have an oblong or elongate profile that allows for anisotropic deformation under lateral loads. Considering their oblong profile, a cleat system 10 will deflect more easily on its latitudinal axis because it is narrower than its longitudinal axis. In the embodiment shown, the oblong structure is hexagonal. The head portion is also in the form of a concentric hexagon to the bottom of the base portion.

Figure 11A:
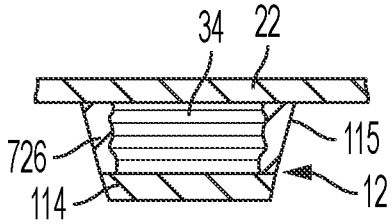
FIG. 11A is an isolated cross-sectional view of a cleat system from FIG. 11 taken along the long axis of the cleat.
Figure 11B:
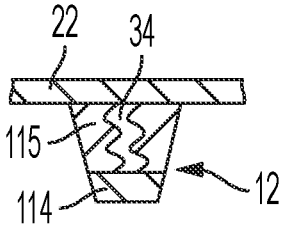
FIG. 11B is an isolated cross-sectional view of a cleat system from FIG. 11 taken along the orthogonal short axis of the cleat.
Figure 11C:
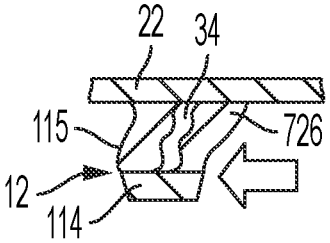
FIG. 11C shows the cross-section of FIG. 11B under lateral load.

FIGS. 11A-B show cross-sections of cleat system 10 when it is not under load, while FIG. 11C, shows the cross-section of FIG. 11B under lateral load (force applied through the latitudinal axis of the cleat system, i.e., orthogonal to the long walls). It can be seen that the cleat system deflects in the direction of the applied load. A similar load applied through the longitudinal axis of the cleat system would be relatively more resistant to deflection. (In all such views in the Figures, unless otherwise indicated, it is assumed that the cleat head is under vertical load, e.g., the load of person wearing a shoe with the cleat system.)

The cleat base portion 115 may include a core region 34 of elastomeric material that has an accordion-like structure that can elastically stretch beyond its compacted height and thereby allow for a greater range of deflection. The accordion structure represents a stiff cord that is initially slack and restricts cleat movement at some predetermined deflection limit, i.e., when slack is taken up.

Figure 12:
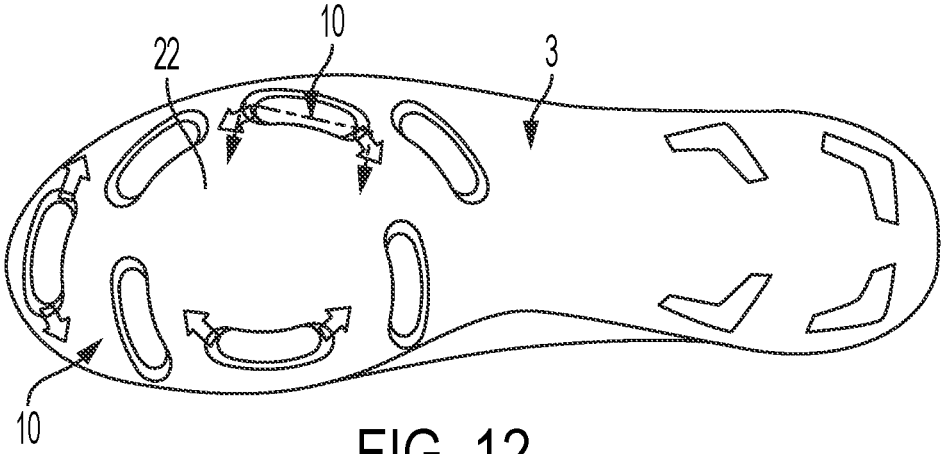

FIG. 12 shows another possible embodiment of a deflectable or deformable cleat system having a plurality of cleat systems 10 disposed on a sole plate 22 of sole unit 3. In this embodiment the cleat systems consist of a cleat 12 having a head portion 214 and base portion 215 and post portion 516. The head portion is essentially a cap. The base portion disposed below the head portion defines a cavity that includes an elastomeric or other compressible material 826. The base portion is configured to allow movement over the sole plate. A post or other anchor 216 that is connected to the sole plate extends from the sole plate into the compressible material. The anchor has a flared or flanged top portion 218. The cleat is retained on the anchor by its embedment in the material 826 and that material's encapsulation in the cleat 10. The flared portion increases the contact surface area for better embedment. The cleat includes abutment ledges 36 that horizontally protrude into the base section's cavity to help retain the material 826. Although the illustrated embodiment shows elastomeric structure around all sides of the anchor, in other embodiments, it could be placed on a selected side or it could be placed in multiple sections at spaced intervals.

As seen, the cleat systems 10 in this embodiment are elongate arcing elements, which naturally have a convex side and a concave side. Some are arranged in the forefoot portion of the sole unit with concave sides facing inward and in a generally end-to-end (but spaced apart) pattern to define a radial (circular) path. Not all cleats are in the path. As can be seen, one cleat system is outside and distal to that path and one cleat system is outside proximal to the path. All cleat systems are positioned and arranged to generally permit a user's foot to pivot around the center the of the circular pattern, which center is at the center of the forefoot portion or thereabout it.

Figure 12A:
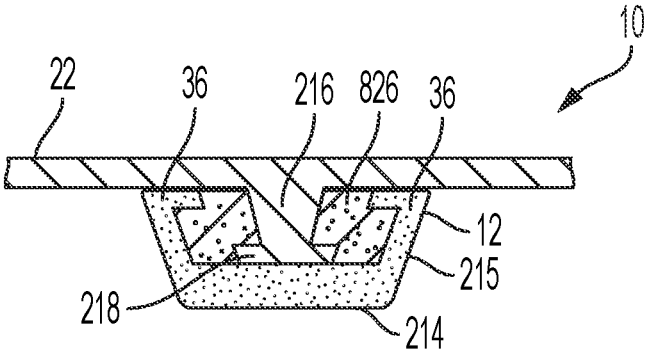
FIG. 12A is an isolated cross-sectional view of a cleat system from FIG. 12 taken along the central line of the illustrated curvature.
Figure 12B:
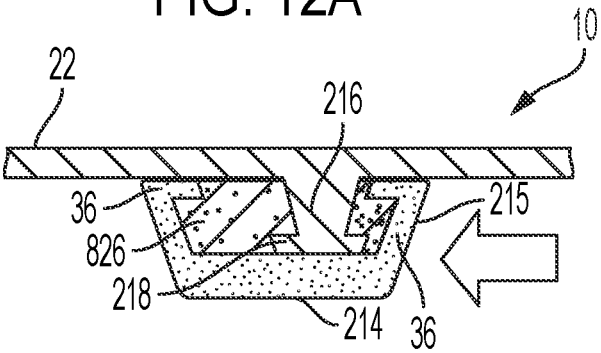
FIG. 12B shows the cross-section of FIG. 12A under lateral load.

Based on the arrangement of cleat systems 10 on generally circular paths, they can rotate on the ground in a radial or arcuate path, as indicated by the arrows in FIG. 12. Looking at FIG. 12A (cleat system in unloaded condition) and 12B (cleat system in loaded condition), based on the free play of a cleat 12 over an anchor 216, the cleat can deflect laterally in response to lateral forces applied to the long walls of the cleat, as indicated by the force arrow shown in FIG. 11B, and the indicated shifting of the cleat 12 in the direction of the applied force. The compressible material applies a return force to return the cleat system to the unloaded condition of FIG. 11A once the force is removed.

Figure 13:
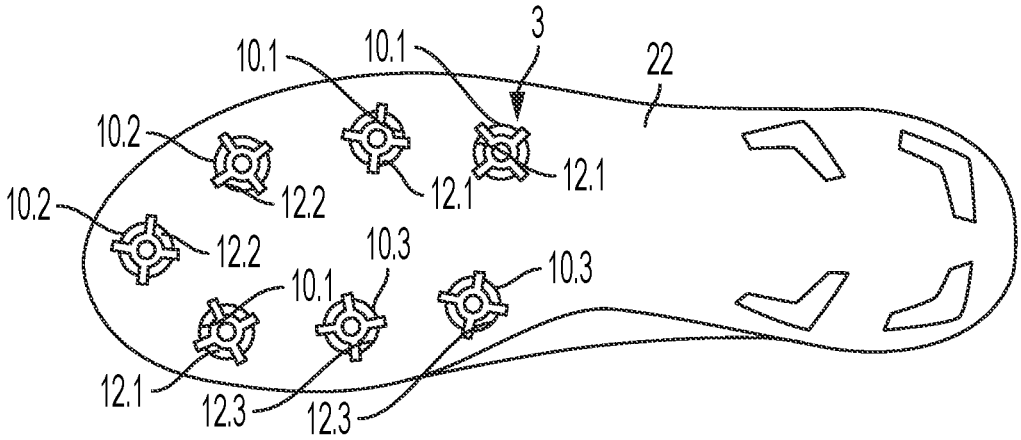
Figure 13A:
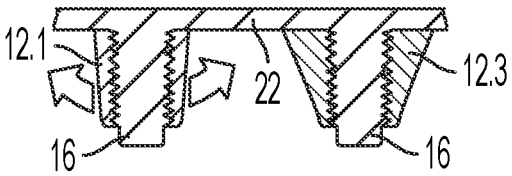
FIG. 13A is an isolated cross-sectional view of a pair of cleat systems from FIG. 13.
Figure 13B:
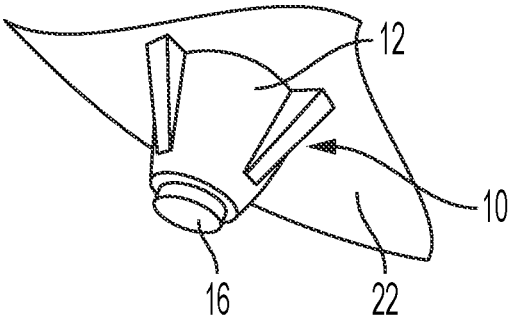
FIG. 13B shows a perspective view of a representative cleat system from FIG. 13.

FIG. 13 shows another possible embodiment of deflectable or deformable cleat systems on a sole unit 3. In this embodiment, sole plate 22 has a plurality of different cleat systems 10.1, 10.2, 10.3 disposed on it. Each cleat system generally is removable so that the sole unit is tunable with cleat systems of different deflectability. In this embodiment, the cleat systems have cleats that include one or more buttresses like those described above in the discussion of FIG. 10. In this case the cleats 12.1, 12.2, 12.3 are removable based on a threaded post system similar to conventional cleat systems or as described above for other embodiments. In this case, the cleats thread on posts 16 disposed on sole plate 3. As seen in FIG. 13A, one cleat, e.g., cleat 12.1 may have less buttressing or it may not have buttressing but is made of less stiff material than another cleat, e.g., cleat 12.3, to provide relative differences in deflectability or deformability. In other embodiments where the cleats do not have buttresses, they may be made of different materials or have different structures or profiles that provide relative differences in deflectability or deformability. FIG. 13B shows a perspective view of a representative cleat system from FIG. 13.

In certain embodiments, both the cleats, which are collared around the posts, and the posts are deflectable or deformable. The cleats are relatively more rigid to limit the movement of the post. But the cleats will generally flex together with the posts. Different cleats have different effects on the posts, e.g., affecting stiffness or providing deflectability or deformation in a selected direction.

Figure 14:
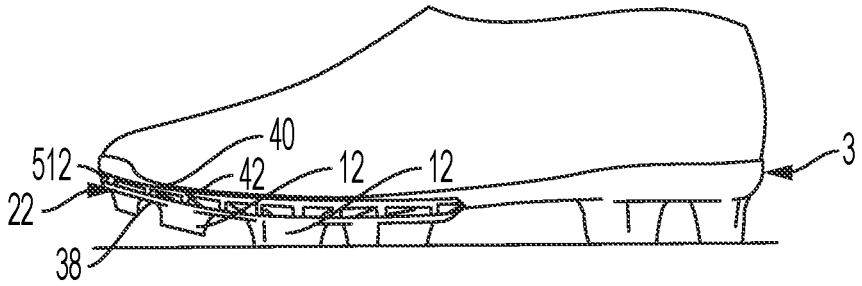

FIG. 14 shows another possible embodiment of a deflectable or deformable cleat system having a plurality of cleat systems 10 disposed on a sole plate 22 of sole unit 3. In this embodiment, a plurality of cleats 12 are connected to a deformable sole plate 22 that is configured to deform in multiple dimensions, so that the cleats on its surface deflect laterally, longitudinally, vertically (i.e., along any of the XYZ axes). As illustrated, the cleats are arranged in a radial pattern around the forefoot portion of the sole unit similar to how the cleats in the embodiment of FIG. 11 are arranged. In this example, the cleats are not strictly arcuate but have a similar form. In this case they are elbow shaped, with one side having an apex and the opposite side being an open angle.

Sole plate 22, it consists of a lower plate 38 on which cleats 12 are disposed, an upper plate 40, and deformable strut elements 42 operationally interconnecting the lower and upper plates. The plates are generally in parallel planes, as seen. The strut elements are deformable or deflectable under force to allow the upper and lower plates to displace relative to one another in the net direction of forces applied along the X, Y, Z axes.

Figure 14A:
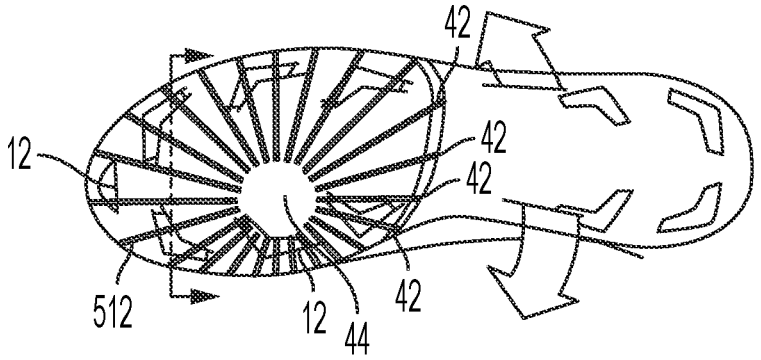
FIG. 14A shows a bottom view of the embodiment of FIG. 14.

In the embodiment shown, the strut elements are thin, elongate elastomeric elements arranged in a radial pattern, as illustrated in FIG. 14A. They are arranged in a circular or radial pattern in the forefoot portion of the sole unit. They each have one end positioned at or close to an edge of the forefoot portion, collectively defining the shape of the forefoot portion (profile in the horizontal plane) and an opposing edge that extends towards a central portion area of the forefoot portion, with the plurality of those strut ends defining a circular area 44 (also looking at the profile in the horizontal plane). In other words, each strut radiates from the perimeter of the circle towards the edges of the forefoot.

In many cases, it will be suitable to tune the sole unit so that pivoting occurs on or about the head of the first metatarsal. As shown, the circle is offset towards the medial side of the forefoot portion to that it corresponds with the head of the first metatarsal. The idea is to locate the (virtual) center of the radial structures under the center of rotation of the forefoot. The center of rotation may (or may not) occur under the first metatarsal head. This radial arrangement tunes the sole unit to allow for radial movement of the lower plate relative to the upper plate, while restricting lateral and longitudinal movement. Notably, the deformation may or may not be symmetrical going clockwise versus counter clockwise.

Figure 14B:
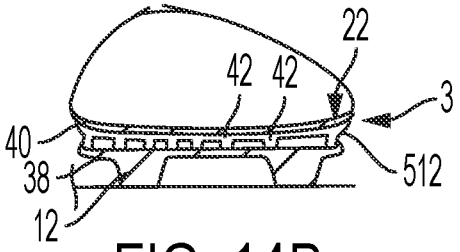
FIG. 14B shows a cross-sectional of the shoe from FIG. 14 view taken along the indicated line in FIG. 14A.

FIG. 14B is a cross section along the cross-sectional line shown in FIG. 14A. It shows the sole unit in an unloaded condition. As seen, struts 42 are orthogonally disposed between the lower and upper plates. (The plates may be a rigid or semi-rigid plate material, as described earlier, e.g., a thermoplastic.)

Figure 14C:
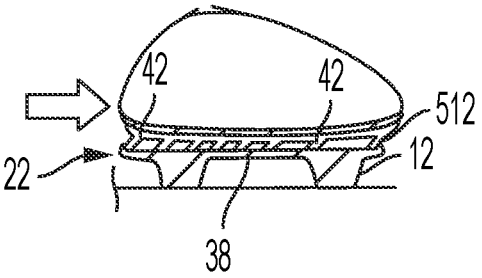
FIG. 14C is the same as FIG. 14B but under a lateral load.

FIG. 14C shows the sole unit under a load applied according to the force arrows of FIGS. 14 and 14A. As seen, under load, the struts shift to a transverse orientation and the upper plate (along with shoe's foot compartment) shifts laterally over the lower plate in the direction of the applied force.

The foregoing is just one possible embodiment for the struts and how they are sized and shaped. Persons skilled in the art will recognize from the teachings herein that many other configurations that allow for a tuned displacement of lower and upper plates are possible from the teachings herein. For instance, instead of elongate elements operationally interconnecting the plates, the plates would be operationally interconnected by other geometrical forms like columns, pillars, spherical elements, or other discrete forms spaced between the plates. Also, elongate elements need not be linear, they can be curvilinear or have other non-linear paths.

Figure 15:
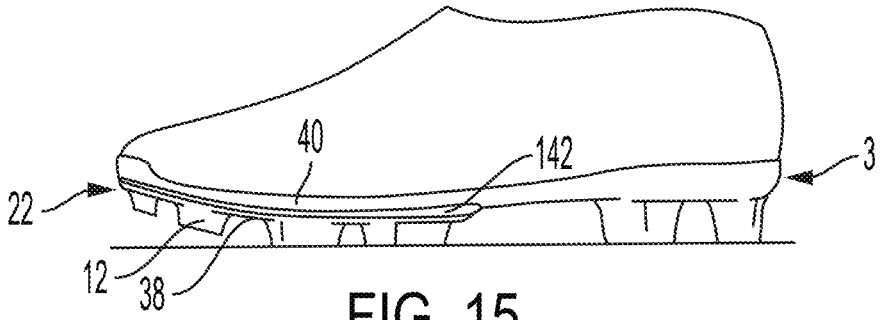
Figure 15A:
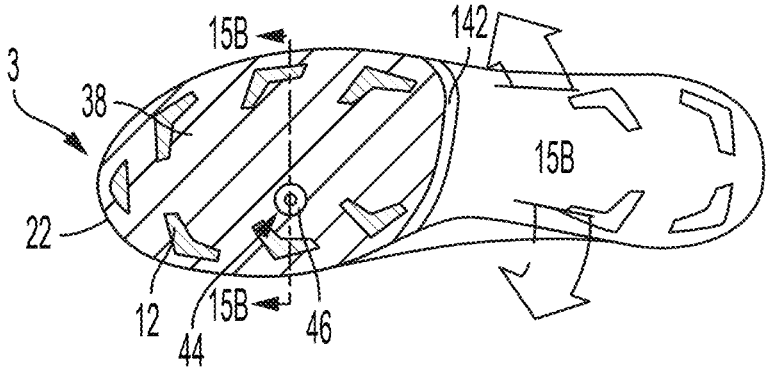
FIG. 15A shows a bottom view of the embodiment of FIG. 15.
Figure 15B:
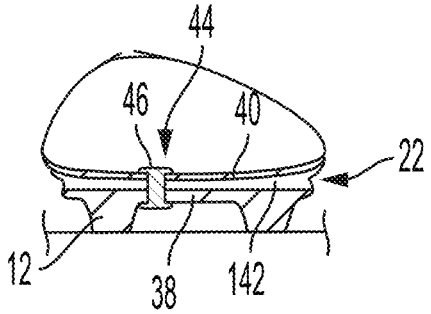
FIG. 15B shows a cross-sectional view of the shoe from FIG. 15 view taken along the indicated line in FIG. 15A.

FIG. 15 shows an embodiment similar to FIG. 14. In this example, instead of struts being disposed between lower plate 38 and upper plate 40 of sole plate 22, an elastomeric pad 142 is disposed between and operationally interconnects the lower plate and the upper plate. The elastomeric pad is a generally planar structure that allows for displacement of the plates at least in a horizontal plane (X, Y axes) and optionally is compressible and thereby allows for vertical (Z axis) displacement. To allow for radial movement of the lower plate relative to the upper plate, like in the embodiment of FIG. 14, sole unit 3 includes a pivot point 44. The pivot action may be attained by providing a pin element 46 that spans the plates 38, 40, and the intermediate elastomer pad, allowing plate 30 to pivot relative to plate 40. One end of the pin may be fixed to one of the plates, and the other end is free in an aperture of the other plate for rotation. For example, the upper end of pin element 46 could be fixed to upper plate 40 at an upper end free in an aperture of lower plate 38. The pin can have a flange structure at one or both ends to engage the surface of an abutting plate.

The elastomeric pad 142 may have a uniform thickness or it may have varying thickness. In the embodiment shown, it tapers downwardly in thickness going from the lateral and medial edges of the forefoot portion. The distal end to proximal end thickness may also vary. For example, as seen, the distal end of the forefoot portion may be thinner than the proximal end.

The illustrated elastomeric pads of FIGS. 14-15 are co-extensive with the forefoot portion of the sole unit. However, in other embodiments, a pad could extend into the midfoot or rearfoot. Or it might only partially overlie the forefoot portion.

Also, a pad can be a continuous or discontinuous structure. A continuous structure would be a sheet of material that has an uninterrupted surface. A discontinuous structure would be a generally planar structure with holes or other perforations within its perimeter, e.g., perforated structures or web structures.

Furthermore, the elastomeric pads could have surfaces that are not planar or smooth. For example, a pad could have an undulating form or other form where, within the pad's perimeter, one of both surfaces of the pad, at regular or irregular intervals, rise above or below a general horizontal base plane (The struts of FIG. 14 may also have varying thickness and surface profiles analogous to the pads.)

Figure 16:
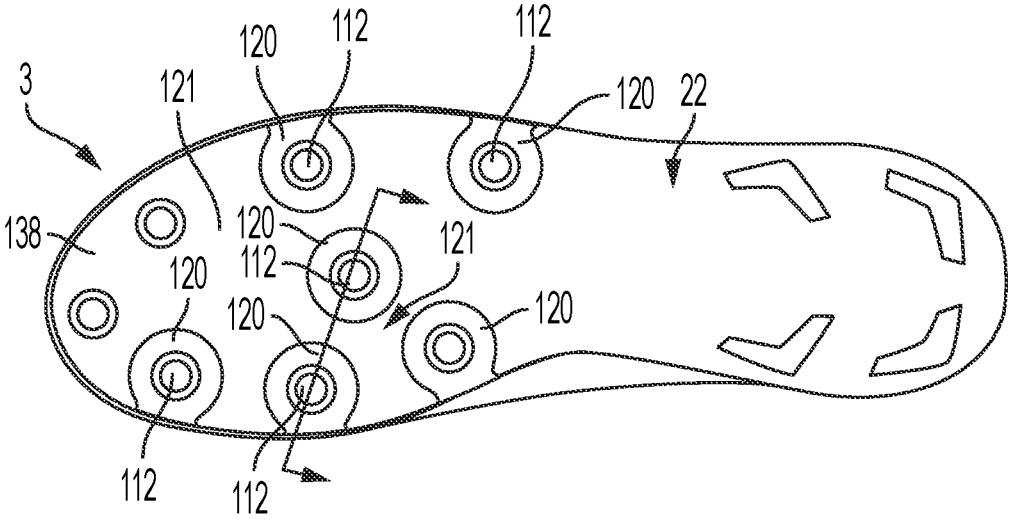

FIG. 16 shows another possible embodiment of a deflectable or deformable cleat system having a plurality of cleat systems 10 disposed on a sole plate 22 of sole unit 3. In this embodiment, a plurality of cleats 12 are connected to a sole plate 22 that is configured with cleat mounting areas 120 that are deformable in at least a vertical direction (Z axis). The sole plate 22 is a system that includes a (1) lower plate 138, which consists of an elastomeric zone, cleat-mounting area 120 and a relatively rigid zone, 121, and (2) an upper plate 140.

The combination of plates operate to create a springboard, i.e., a spring compression, effect in the sole unit. A sufficient vertical or compressive force between the user's foot and the ground causes the plates to converge. The degree of convergence depends on the reactive ground force. A softer ground surface will yield and provide lower reactive force and less convergence, and a firmer ground surface will provide a higher ground force and more convergence. Accordingly, each cleat can adapt to the nature of the surface it encounters and dissipate force more optimally than conventional systems that have cleats mounted on rigid plates, which do not allow cleats to individually yield to varying ground surfaces. As explained in more detail below, the lower and upper plates have differential firmness so that one plate elastically deforms relative to another under compressive loads. Opposing surfaces of the plates are separated by one or more spacers that engage an elastically deformable surface to deform that surface under load. When the load is removed, the sole plate system dissipates stored energy, returning the plates to their original condition.

Looking at sole unit of FIG. 16, in more detail, the exposed mounting areas 120 of lower plate 138 may be made of a more elastic material than surrounding areas 121 of lower plate 138. The idea is that the cleats are attached to the elastic plate (film.) The cleats recess or retract when encountering a hard surface.

Cleats 12 disposed on the mounting areas may be a firm plastic or elastomer of a conventional type suitable for engaging the ground and providing traction. However, unlike traditional cleats, the cleats according to this embodiment of the inventive subject matter include a channel 415 that receives a post 416 disposed on the lower surface of upper plate 140. The post is slidable in the channel along the vertical (longitudinal) axes of the post and cleat. The post and channel are shown configured with a complementary, close fit. In this example, the post and channel have cylindrical profiles. Under a compressive force, the post moves downwardly into the channel. The channel has a closed end or other abutment surface to limit the travel of the post. In this case, the abutment surface is at or near the end head of the cleat.

Figure 16A:
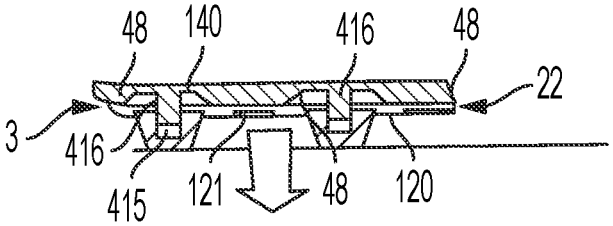
FIG. 16A is an isolated cross-sectional view of a cleat system from FIG. 16 taken along the indicated line in FIG. 16.
Figure 16B:
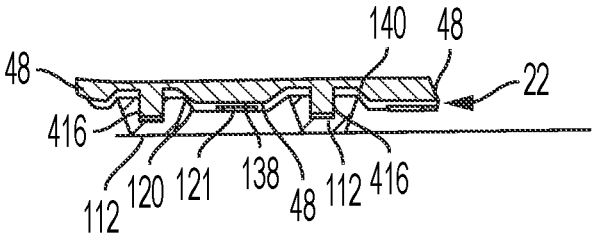
FIG. 16B shows the cross-section of FIG. 16A under vertical (compressive) load.

FIG. 16A shows the sole plate 22 in an unloaded condition. In this condition, spacer portions 48 of the upper plate 140 offset upper plate 140 from lower plate 138. The spacers may be protruding areas on the lower surface of upper plate 140. FIG. 16B shows sole plate 22 under load, as indicated by the force arrow. Under sufficient load, the spacers 48 engage the top surface of lower plate 138 and deform it downwardly. The upper plate in this embodiment is a rigid or semi-rigid structure, and the lower plate, at least in the cleat mounting area, is an elastic structure (which may still have some supportive rigidity sufficient to restrict deformation when a user is in static position). The spacers may be formed of material the same as or different from the general upper plate material. They have a firmness sufficient to deform the corresponding, underlying lower plate portion under sufficient force, e.g., forces encountered of dynamic use.

From the teachings for the embodiments of FIGS. 14-16, elastomeric elements may be disposed between upper and lower plates, and/or one or both of the sole plates may have elastomeric portions in at least a cleat mounting area, to allow for tuned displacement of cleats disposed on a lower plate. Unlike earlier embodiments, any cleat or cleats on such plates or elastomeric portion would simultaneously deflect or displace with the movement of the lower plate or elastomeric portion.

U.S. Pat. No. 6,516,540, which is hereby incorporated by reference in its entirety for all purposes, describes elements for footwear that provide for deformation under shear force. These elements are specifically designed to deform three dimensionally. The elements, therefore, may deform vertically (i.e., compress perpendicular to the ground surface toward the foot) as well as horizontally (i.e., shear or deform in a plane parallel to the ground surface). In this way, these elements dissipate the energy of foot impact and simultaneously reduce force transference in these three directions and reduce overall stress and strain on a wearer's feet, ankles, knees, back and joints. The '540 patent, however, does not teach or suggest the use of parallel upper and lower plates, or how to adapt its elements for use on cleated or studded footwear. Using the teachings herein, it will be appreciated how structures and materials disclosed in the '540 patent may be suitable for adaption with the invention subject matter disclosed herein.

Figure 17:
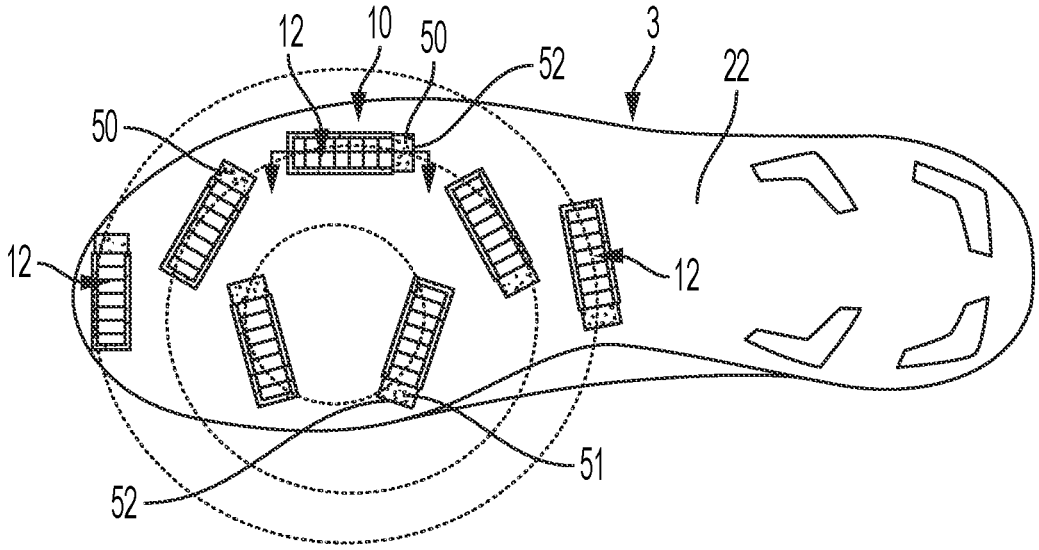

FIG. 17 shows yet another possible embodiment of deflectable or deformable cleat systems on a sole unit 3. In this embodiment, sole plate 22 has a plurality of cleat systems 10 disposed on it. In this embodiment, each cleat 12 has top portion and base portion. The base portion is fixed to the sole plate 22. The top portion is segmented along lines generally orthogonal to the surface of the sole plate. Each segment 12.1, 12.2, 12.3 . . . 12.*x* is therefore laterally displaceable under sufficient force. There may be any number of segments disposed on a cleat base, from 2, 3, 4, 5, 6, 7, 8, 9, 10, or more. They may abut one another, or they may be spaced apart but sufficiently close so that collectively they act like a unitary cleat structure when they are under static load or light force. Under sufficient force, they are displaceable in the opposite direction of the applied force.

Figure 17A:
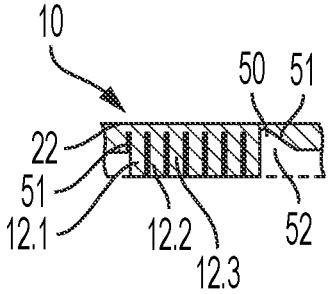
FIG. 17A is an isolated cross-sectional view of a cleat system taken along the indicated line in FIG. 17.
Figure 17B:
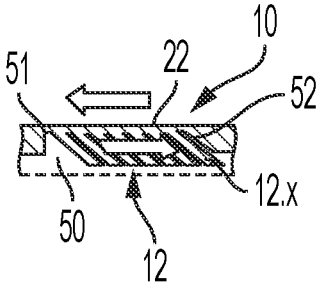
FIG. 17B shows the cross-section of FIG. 17A under lateral load.

As seen, the cleats are arranged in a generally radial pattern, and cleats can be arranged along and to move in radial paths, as indicated by the dashed lines in FIG. 17. To control the direction of displacement of the segments, they may be disposed in a groove or slot that anisotropically controls the direction and/or range of deflection. For example, FIG. 17A shows a cross section of a cleat 12 disposed in a groove 50. The cleat 12 has a length that is less than the length of the groove. The groove has opposing side walls. A first sidewall 51 is disposed against or closely adjacent a segment 12.1. Therefore, the segment is blocked from displacing in the direction of that sidewall, and so are other segments given that they are compacted arranged together. On the other hand, opposing, second sidewall 52 is spaced from the nearest end segment, 12.*x*. Therefore, there is a gap between that segment and the sidewall so that segment 12.*x* and all other segments can displace towards the sidewall in response to sufficient force in the opposing direction, as indicated by the arrows seen in FIG. 17B. The degree of displacement is controlled by the size of the gap. The sidewall may be angled, as shown in FIG. 17B, so that the segments neatly stack against one another, in parallel, without folding or bunching once the segment 12.*x* abuts sidewall 52. The idea is less traction after a certain torque is reached. The lower cleat height and angle of cleat both contribute to reducing torque.

Figure 18:
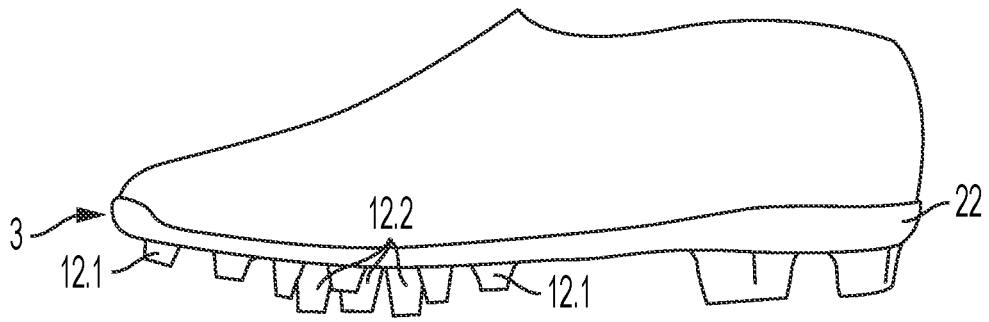
Figure 18A:
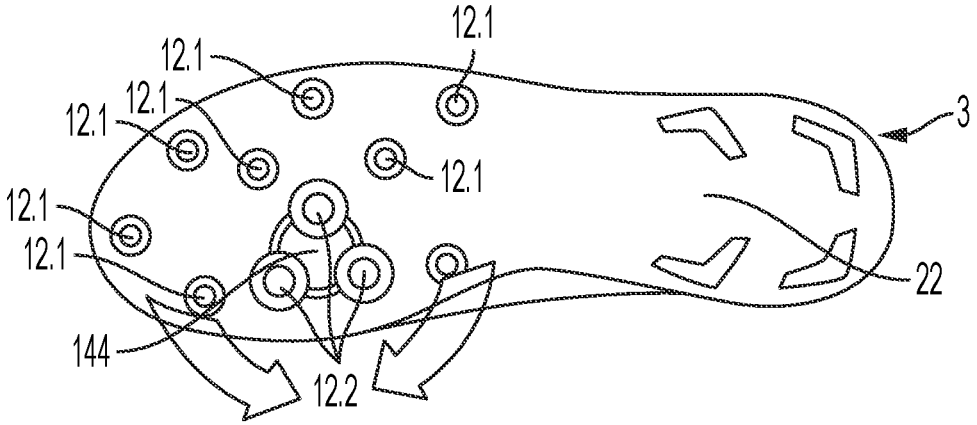
FIG. 18A shows a bottom view of the embodiment of FIG. 18.
Figure 19:
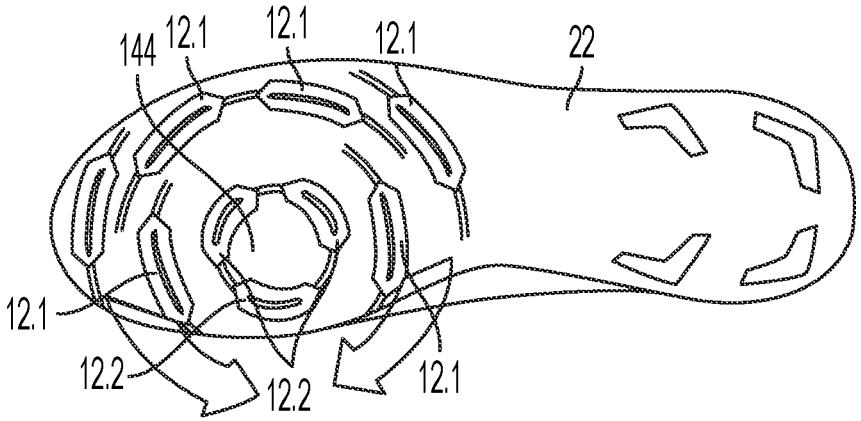

FIG. 18 shows still another possible embodiment of deflectable or deformable cleat systems on a sole unit 3. In this embodiment, sole plate 22 has a plurality of different cleat systems 12.1 and 12.2 disposed in a forefoot portion of the sole plate. One set of cleats is configured to provide for pivoting around a point defined by the arrangement of cleats and the other set being configured to avoid impeding the pivoting action. For example, three cleats 12.2 are evenly spaced and disposed around a selected pivot point 144, which in this example is configured to correspond to the first metatarsal head or thereabout. Cleats 12.2 are longer than cleats 12.1. This arrangement favors ground contact by cleats 12.2, with the shorter cleats 12.1 having reduced or no contact, so that pivoting occurs around the pivot point defined by the radial arrangement of cleats 12.2. The cleats that define a pivot point may number more than three, e.g., 4, 5, 6, 7. 8, or more. They may have varying shapes. For example, FIG. 19 shows radial patterns of cleats on a sole unit 3. The cleats 12 in this embodiment have an elongate, arcing shape, in contrast to the pillar-like cleats of FIG. 18.

FIG. 19 also shows other aspects of the inventive subject matter. There is an outer radial pattern of cleats 12.1. There is also an inner radial pattern of cleats 12.2 on sole unit 22, with a pivot point 144 defined in the center of the inner pattern. Cleats 12.2 may be longer than cleats 12.1.

Figure 19A:
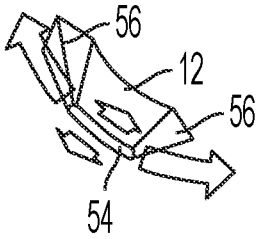
FIG. 19A is an isolated perspective view of a cleat system from FIG. 19.

The inner and outer radial patterns, with or without differences in cleat length in the patterns, allow for radial movement, as indicated by the longer force arrows of FIGS. 19 and 19A, while limiting lateral and longitudinal movement, as indicated by the force short force arrows of FIG. 19A. As seen, the arcing cleats taper from top to bottom. Thereby, the narrower tops 54 are configured for ground penetration. They may also have tapered side walls 56 as shown so that they can cut into and rotate more easily through the ground.

From the foregoing, it can be seen that the inventive subject matter provides advantageous sole units and cleat systems for an athletic or other high-traction footwear, which may increase the performance and safety of the shoe in response to forces on the footwear.

Persons skilled in the art will recognize that many modifications and variations are possible in the details, materials, and arrangements of the parts and actions which have been described and illustrated in order to explain the nature of the inventive subject matter, and that such modifications and variations do not depart from the spirit and scope of the teachings and claims contained therein.

All patent and non-patent literature cited herein is hereby incorporated by references in its entirety for all purposes.

As used herein, "and/or" means "and" or "or", as well as "and" and "or." Moreover, any and all patent and non-patent literature cited herein is hereby incorporated by references in its entirety for all purposes.

The principles described above in connection with any particular example can be combined with the principles described in connection with any one or more of the other examples. Accordingly, this detailed description shall not be construed in a limiting sense, and following a review of this disclosure, those of ordinary skill in the art will appreciate the wide variety of systems that can be devised using the various concepts described herein. Moreover, those of ordinary skill in the art will appreciate that the exemplary embodiments disclosed herein can be adapted to various configurations without departing from the disclosed principles.

The previous description of the disclosed embodiments is provided to enable any person skilled in the art to make or use the disclosed innovations. Various modifications to those embodiments will be readily apparent to those skilled in the art, and the generic principles defined herein may be applied to other embodiments without departing from the spirit or scope of this disclosure. Thus, the claimed inventions are not intended to be limited to the embodiments shown herein but are to be accorded the full scope consistent with the language of the claims, wherein reference to an element in the singular, such as by use of the article "a" or "an" is not intended to mean "one and only one" unless specifically so stated, but rather "one or more".

All structural and functional equivalents to the elements of the various embodiments described throughout the disclosure that are known or later come to be known to those of ordinary skill in the art are intended to be encompassed by the features described and claimed herein. Moreover, nothing disclosed herein is intended to be dedicated to the public regardless of whether such disclosure is explicitly recited in the claims. No claim element is to be construed as "a means plus function" claim under US patent law, unless the element is expressly recited using the phrase "means for" or "step for".

The inventors reserve all rights to the subject matter disclosed herein, including the right to claim all that comes within the scope and spirit of the following claims:

The invention claimed is:

1. A sole portion of a shoe, comprising:

a plurality of cleat systems disposed on a sole plate comprising an upper plate and a lower plate that are interconnected by an elastomeric structure, each cleat system comprising a cleat disposed on the lower plate, each cleat having a head portion for engaging a ground surface and a base portion that is disposed on the lower plate, the lower and upper plates being arranged in non-overlapping, generally parallel planes so that the upper and lower plates are configured to laterally and axially displace relative to one another along an X and/or Y axis; and wherein under load the elastomeric structure shifts to a transverse orientation and the upper plate, along with an associated foot compartment, shifts axially and laterally over the lower plate in the direction of an applied force.

2. The sole portion of claim 1 wherein each cleat system having the head portion that is relatively firmer than the base portion, the base portion being made of an elastomeric material that is laterally deflectable or deformable under higher loads typically encountered in athletic or outdoor use, and wherein the base portion has an oblong or elongate profile that allows for anisotropic deformation under lateral loads.

3. The sole portion of claim 1 wherein the cleat systems or cleats are arranged in a generally radial pattern.

4. The sole portion of claim 3 wherein the cleats have an elongate, arcing shape.

5. The sole portion of claim 1 wherein the elastomeric structure comprises an elastomeric pad that is disposed between the lower and upper plates and interconnected to one or both plates, the deformation of the elastomeric pad, allowing for the relative movement of the plates.

6. The sole portion of claim 1 wherein the elastomeric structure comprises a plurality of elastomeric strut elements are disposed between the lower and upper plates and are operationally interconnected to one or both plates, the deformation of the elastomeric struts allowing for the relative movement of the plates.

7. The sole portion of claim 1 wherein the lower and upper plates have differential firmness so that one plate elastically deforms relative to another under compressive loads, opposing surfaces of the plates being separated by one or more spacers disposed on one of the opposing surfaces of a plate that engage an elastically deformable surface of the opposing plate to deform that surface under load.

8. The sole portion of claim 1 wherein the sole portion comprises a forefoot portion.

9. The sole portion of claim 8 wherein the sole portion is configured with a pivot point at or about a position corresponding to the first metatarsal head.

10. A sole portion of a shoe, comprising:

a plurality of cleat systems comprising a plurality of cleats disposed on a sole plate, the sole plate comprising an upper plate and a lower plate that are interconnected by an elastomeric structure, the lower and upper plates being arranged in non-overlapping, generally parallel planes so that the upper and lower plates are configured to axially and laterally and axially displace relative to one another along an X and/or Y axis, wherein under load the elastomeric structure shifts to a transverse orientation and the upper plate, along with an associated foot compartment, shifts axially and laterally over the lower plate in the direction of an applied force; and wherein the lower and upper plates have differential firmness so that one plate elastically deforms relative to another under compressive loads, opposing surfaces of the plates being separated by one or more spacers disposed on one of the opposing surfaces of a plate that engage an elastically deformable surface of the opposing plate to deform that surface under load.

11. The sole portion of claim 10 wherein the sole portion comprises a forefoot portion.

12. The sole portion of claim 11 wherein the sole portion is configured with a pivot point at or about a position corresponding to the first metatarsal head.

* * * * *